United States Patent [19]

Doi

[11] 4,157,143

[45] Jun. 5, 1979

[54] SALES PROMOTING-PURPOSE BOTTLE CLOSURE

[75] Inventor: Kouichi Doi, Inuyama, Japan

[73] Assignee: Japan Crown Cork Co., Ltd., Tokyo, Japan

[21] Appl. No.: 886,579

[22] Filed: Mar. 14, 1978

[30] Foreign Application Priority Data

Sep. 26, 1977 [JP] Japan ..... 52/128448[U]

[51] Int. Cl.[2] ..... B65D 53/04

[52] U.S. Cl. ..... 215/228; 40/311; 215/254

[58] Field of Search ..... 215/227, 228, 230, 253, 215/254, 256, 328, 365; 40/311

[56] References Cited

U.S. PATENT DOCUMENTS

| | | | |
|---|---|---|---|
| 3,233,770 | 2/1966 | Waters | 215/230 |
| 3,257,021 | 6/1966 | Brockett | 215/328 |
| 3,332,565 | 7/1967 | Elser | 215/256 X |
| 3,581,690 | 6/1971 | Zapata | 113/121 A |
| 4,030,630 | 6/1977 | Yealy | 215/256 X |

*Primary Examiner*—Donald F. Norton

*Attorney, Agent, or Firm*—Wenderoth, Lind & Ponack

[57] ABSTRACT

A sales promoting-purpose closure comprising a closure shell having the indication of a prize offer on its inner bottom surface and a gasket peelably bonded to the inner bottom surface of the shell. The gasket either only partially adheres to the inner bottom surface of the closure shell at least at its center panel or not at all, and the center panel has a tear strip portion defined by a breakable line.

3 Claims, 9 Drawing Figures

SALES PROMOTING-PURPOSE BOTTLE CLOSURE

BACKGROUND OF THE INVENTION

This invention relates to a bottle closure having a peelable gasket which is adapted to be used for sales promoting purposes. More specifically, it relates to a sales promoting-purpose bottle closure having a gasket which is rendered more easily peelable than heretofore by forming a tear strip portion.

Many types of sales promoting-purpose bottle closures have been suggested (see, for example, U.S. Pat. Nos. 1,711,469, 3,233,770, 3,257,021, 3,361,281, 3,581,690, and 3,633,781). In these conventional sales promoting-purpose bottle closures, the gasket is adapted to be removed from the closure shell by inserting a finger nail or a pointed tool between the peripheral end of the gasket and the closure shell and picking it upwardly. Although the gasket is bonded weakly to the inner bottom surface of the closure shell to enable the gasket to be removed easily, the bond force is still relatively high because of the need to prevent the detaching of the gasket by vibration and other physical actions during the transportation of bottle closures and a bottle sealing operation or to ensure good bottle sealing. The gasket, however, is frequently difficult to pick up, especially when a finger nail is used. Moreover, it is risky, especially for children, to lift the gasket by using a sharp tool, and in fact, an injury caused by this effort has been reported.

There has been, therefore, an increasing demand in the art for sales promoting-purpose bottle closures provided with gaskets that can be peeled off easily by hand without using a sharp tool.

SUMMARY OF THE INVENTION

It is an object of this invention to provide an improved sales promoting-purpose bottle closure which is free from the defects described above.

Another object of this invention is to provide an improved sales promoting-purpose bottle closure which is provided with a gasket that can be easily peeled off by hand without using a sharp tool.

Other objects and advantages of this invention will become apparent from the following description.

According to this invention, there is provided a sales promoting-purpose closure comprising a closure shell having the indication of a prize offer on its inner bottom surface and a gasket peelably bonded to the inner bottom surface of the shell, wherein the gasket is held half-adhering or non-adhering to the inner bottom surface of the closure shell at least at its center panel, and the center panel has a tear strip portion defined by a breakable line.

BRIEF DESCRIPTION OF THE INVENTION

The bottle closure of this invention is described in detail below with reference to the accompanying drawings in which.

Figure 1:
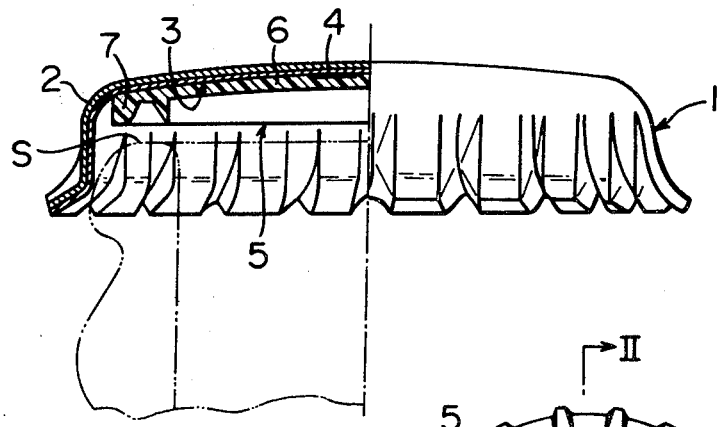
FIG. 1 is a partly cut-away side elevation of the closure of this invention.

In FIG. 1 which shows the entire arrangement of the bottle closure provided by the present invention, closure 1 consists basically of a shell 2 having a prize offer indication 4 on its inner bottom surface 3, and a gasket 5 bonded to the inner bottom surface 3. As a typical example of the shell 2, FIG. 1 shows a crown cap shell. The present invention, however, is equally applicable to other types of bottle closures such as a roll-on pilfer proof cap shell, a roll-on cap shell, a pre-screw cap shell and a lug cap shell.

The material for the gasket applied to the closure shell is not critical, and various synthetic resins known in the art can be used. Typical examples are polyolefins such as polyethylene or polypropylene, rubbers such as a styrene-butadiene rubber, and polyvinyl chloride. Polyethylene is an especially suitable material for the gasket used in the present invention.

The prize offer indication 4 on the inner bottom surface 3 of the closure shell 1 can be provided by printing as in the case of the conventional sales promoting-purpose crown caps. It is adapted to be transferred to the gasket to be peeled off, as required. Such a transferable indication of a prize offer for sales promoting purposes is known, and disclosed, for example, in U.S. Pat. Nos. 3,257,021, 3,361,281, 3,581,690 and 3,633,781.

In the closure of this invention, the gasket 5 is held half-adhering or non-adhering to the inner bottom surface 3 of the shell 2 at least at its center panel 6.

The peripheral sealing portion 7 of the gasket can also be held non-adhering or half-adhering (easily destroyable by a weak force) to the inner bottom surface 3 of the closure shell 2. As a matter of course, however, when the center panel 6 of the gasket is held non-adhering to the inner surface 3, the peripheral sealing portion 7 of the gasket cannot be held non-adhering to the inner bottom surface 3 of the closure shell, but should be held half-adhering to it. Otherwise, the gasket 5 would not be bonded to the inner surface 3 of the closure shell, and the desired closure would be unable to be provided.

Generally, it is desirable that the peripheral sealing portion of the gasket should be half-adhering at least partly to the inner bottom surface of the closure shell. When the closure of this invention is intended for use in sealing a bottle which contains an article with a high inner gas pressure such as carbonated beverages, the peripheral sealing portion of the gasket should not necessarily half-adhere to the inner surface of the closure shell, and may be substantially non-adhering to it.

Throughout the present specification and the appended claims, the term "center panel" of the gasket denotes a thin central portion of the gasket which does not make contact with the sealing end (the portion indicated by the letter "S" in FIG. 1) of a container to be closed. The term "peripheral sealing portion" of the gasket denotes a thick peripheral edge portion of the gasket which comes into close engagement with the sealing end of a container to be closed to form a gas- and liquid-tight seal.

Any known method can be used to hold at least the center panel of the gasket half-adhering or non-adhering to the inner bottom surface of the closure shell. For example, the entire gasket can be held half-adhering to the inner surface of the closure shell by coating or printing the entire inner bottom surface of the closure shell with a lacquer or ink which adheres weakly to the gasket. A lacquer or ink which adheres weakly (half-adheres) to the gasket can be coated or printed on that area of the inner bottom surface of the shell which the peripheral sealing portion of the gasket will contact, and a lacquer or ink which does not substantially adhere to the gasket can be coated or printed on that area of the inner bottom surface of the shell which will contact the center panel of the gasket. Or conversely, the substantially non-adhering lacquer or ink can be coated or printed on that area of the inner bottom surface of the closure shell which the peripheral sealing portion of the gasket will contact, and the weakly adhering lacquer or ink can be coated or printed on that area of the inner bottom surface of the shell which the center panel of the gasket will contact. Furthermore, when the entire inner bottom surface of the closure shell is held half-adhering to the gasket, the adhesion strength may be varied between the area to be contacted with the center panel of the gasket and the area to be contacted with its peripheral sealing portion. An alternative method comprises coating the entire inner bottom surface of the closure shell with a lacquer or ink which adheres firmly to the gasket, and printing entirely or in halftone dots of varying densities that area of the inner bottom surface of the closure shell which will make contact at least with the center panel of the gasket with a lacquer or ink which does not substantially adhere to the gasket, whereby the adhesion of the center panel to the printed portion of the inner bottom surface of the closure can be adjusted to a state which ranges from a half-adhering to a substantially non-adhering state.

Furthermore, by utilizing the method disclosed in German Offenlegungschrift No. 2,711,727, at least the center panel of the gasket can be maintained half-adhering to the inner bottom surface of the closure shell. The methods disclosed in Japanese Laid-Open Patent Publications Nos. 126484/1974 and 150188/1977 can also be used.

When polyethylene is used as a gasket material, the lacquer or ink for firm bonding may be the one composed mainly of oxidized polyethylene as disclosed in British Patent Specification No. 1,484,209. Suitable half-adhering or non-adhering lacquers or inks used in this case include a blend of a small proportion of oxidized polyethylene with another compatible resin, and those containing an epoxy-phenol resin, an epoxy-urea resin or an alkyd resin. When polyvinyl chloride is used as a material for the gasket, the lacquer or ink for firm bonding may be the one which consists mainly of a vinyl chloride-vinyl acetate copolymer or an acrylic resin. Non-adhering lacquers or inks used in this case are preferably those which contain an epoxy-phenol resin, an epoxy-urea resin or an alkyd resin as a main ingredient.

Figure 2:
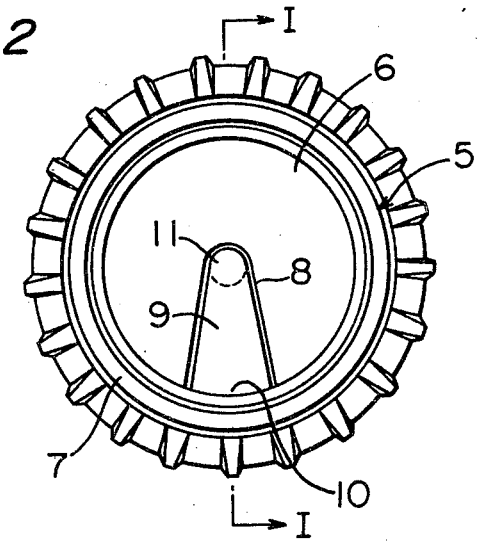
FIG. 2 is a top plan of the closure of the invention with its inside on top.

The important feature of the closure of this invention is that the center panel 6 of the gasket 5 has a tear strip portion 9 which is formed by defining the center panel with a breakable line 8, and which can be cut off and lifted from the other part of the center panel. The breakable line 8 may be a score incised on the center panel 6 of the gasket 5, as shown in FIGS. 1 or 2. Or it may be a slit-like line which extends to the inner bottom surface 3 of the closure shell, or a perforation line. In short, any line or groove is feasible which can permit the separation of a part of the center panel 6 in a strip form along the breakable line 8 without any great force.

As shown in FIG. 2, the tear strip portion 9 is formed by only partially surrounding a part of the center panel 6 of the gasket 5 by the breakable line 8 leaving a discontinuous part (bridging part) 10, thereby to allow the tear strip portion 9 to be integral with the remainder of the gasket at the discontinuous portion (bridging portion) 10 of the breakable line 8.

Figure 3:
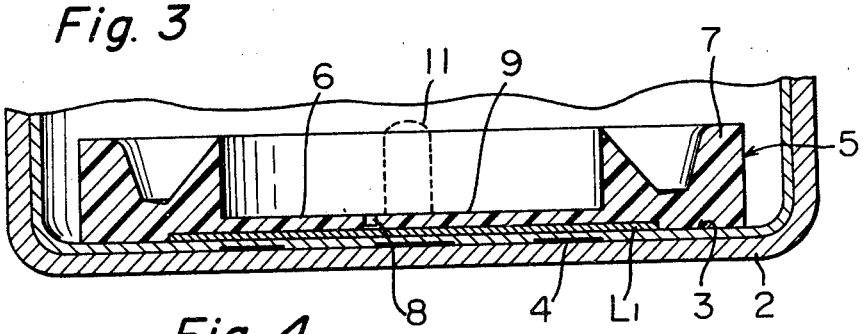
FIG. 3 is an enlarged sectional view taken along the line I—I of FIG. 2.

In picking up the gasket 5 in the closure shown in FIGS. 2 and 3, the tear strip portion 9 is first lifted by a finger nail and further pulled up by holding it with fingers. Since the tear strip portion 9 is integral with the center panel 6 or the peripheral sealing portion 7 at the discontinuous portion 10 and the center panel 6 is held half-adhering or non-adhering to the inner bottom surface 3 of the shell 2 by the half-adhering or non-adhering lacquer layer $L_1$, a part of the center panel 6 or the peripheral sealing portion 7 is removed and lifted from the inner bottom surface 3 of the closure shell by the force of lifting the tear strip portion 9. Finally, the entire gasket 5 is completely peeled off, and can be removed from the closure shell. The removal of the gasket 5 makes visible the prize offer indication 4 applied to the inner bottom surface 3 beneath the gasket 5.

FIG. 3 shows an example in which the prize offer indication 4 remains on the inner bottom surface 3 of the closure shell. In the alternative embodiment shown in FIG. 4, the prize offer indication 4 is printed on a lacquer layer $L_2$ to which the gasket adheres firmly, and a lacquer layer $L_3$ which is substantially non-adhering to the lacquer layer $L_2$ is provided in an area between the lacquer layer $L_2$ and the inner bottom surface of the closure shell which corresponds to the gasket 5. According to this embodiment, the lacquer layer $L_2$ breaks at the part shown by dotted line in the drawing by the operation of separating the gasket 5, and is thus lifted together with the gasket 5. Consequently, the prize offer indication 4 is transferred to the back surface of the gasket 5, and removed from the closure shell. The gasket 5 having the prize offer indication 4 so transferred can be directly used for the purpose of assigning the prize.

Figure 4:
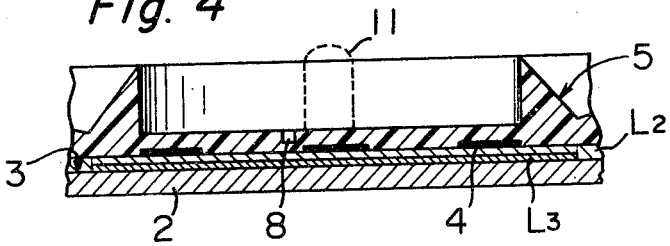
FIG. 4 is an enlarged view, partly in section, of a modification of the closure shown in FIG. 2, in which the indication of a prize offer is given transferably.

It has been stated above with reference to FIGS. 2 and 3 that the tear strip portion 9 is lifted by a finger nail. To facilitate the operation of lifting the tear strip portion 9, the provision of a knob 11 at the tip of the tear strip portion 9, as shown by the dotted lines in FIGS. 2, 3, and 4, is desirable. The shape and size of the knob 11 are not critical, and it may be of such a size and shape that are as small as possible but permit holding by fingers. Advantageously, it should have a height of about 2 to 5 mm, and a maximum diameter of about 2 to 5 mm, although the dimensions may vary according to the size of the closure shell. The shape of the knob 11 may, for example, be dome-like, spherical, cylindrical, or rectangular pillar-shaped.

Figure 5:
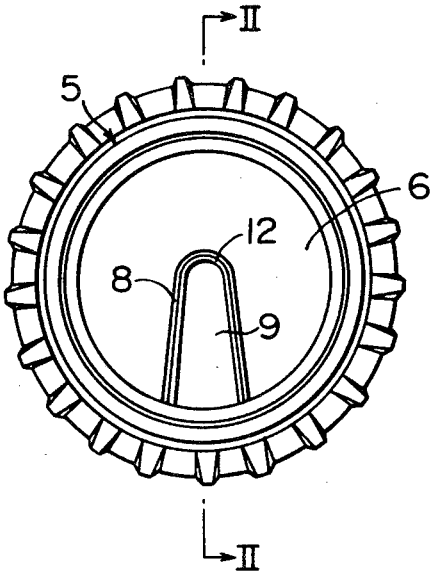
FIG. 5 is a top plan of another embodiment of the closure of the invention with its inside on top.
Figure 6:
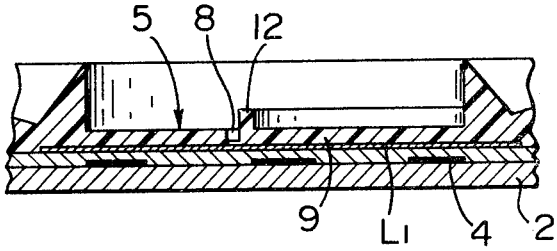
FIG. 6 is an enlarged sectional view taken along the line II—II of FIG. 5.

In another embodiment, a rib 12 projecting along the breakable line 8 defining the tear strip portion 9 may be formed as shown in FIGS. 5 and 6. This makes it easier to hook a finger nail on the rib portion 12 at the end of the tear strip portion 9, and to lift the tear strip portion 9. It brings about another advantage of reinforcing the tear strip portion 9.

Figure 7:
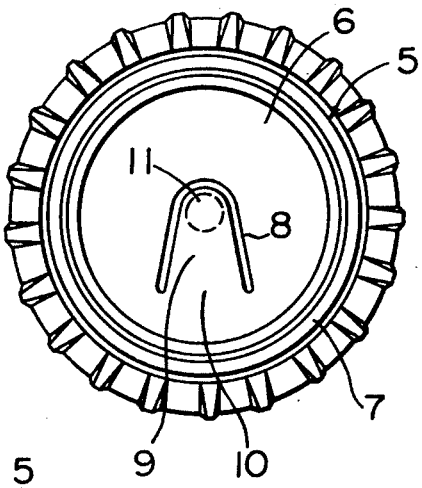
FIGS. 7B and 7C are top plans showing various shapes of the tear strip portion of the closure of this invention with the inside of the closure on top.
Figure 7:
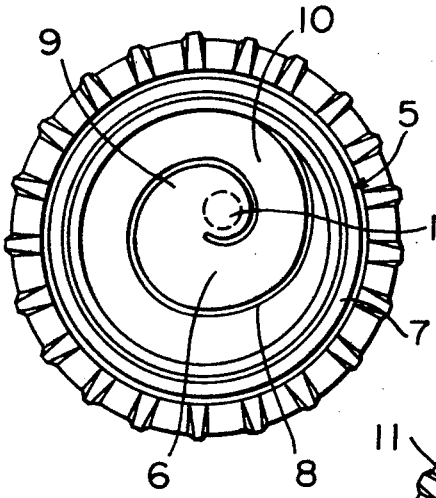
Figure 7C:
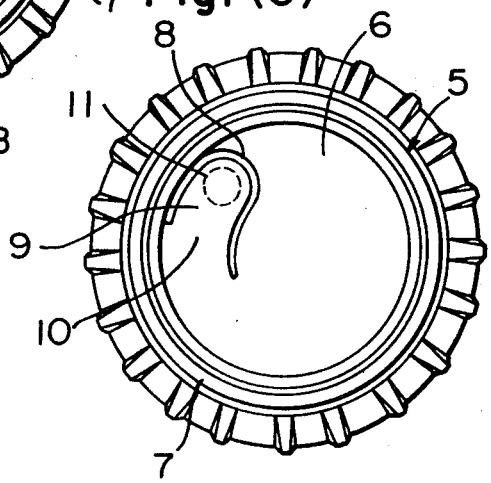

The tear strip portion 9 is wedge-shaped in FIG. 2, but this shape is not limitative. For example, various shapes shown in (A), (B) and (C) in FIG. 7 may be employed. As shown in (A) of FIG. 7, both ends of V-shaped breakable line 8 are made to terminate before they reach the peripheral sealing portion 7. Alternatively, as shown in FIG. 7, (B), coil-like breakable line 8 extending from the center of the center panel 6 to near the peripheral sealing portion 7 is incised. In FIG. 7, (C), a U-shaped breakable line 8 is provided at a suitable position of the center panel of the gasket, for example along the peripheral sealing portion 7.

A knob 11 may, of course, be provided as shown by the dotted lines in FIG. 7, (A), (B) and (C), at the end of the tear strip portion 9 surrounded by the breakable line 8.

The gasket of the various special shapes described above can be applied to the inner bottom surface of a closure shell by an ordinary molding method. Molding can be rendered easy by using a molding punch which has a projection or a depression for forming a breakable line and as required, a knob or rib on its surface.

Since the center panel of the gasket bonded to the inner bottom surface of the closure shell in accordance with this invention has a tear strip portion, the gasket can be removed very easily without using a tool. Thus, the closure is very suitable for sales promoting purposes, and contributes greatly to the promotion of the selling of articles packed into bottles which are sealed by the closures of this invention.

What is claimed is:

1. A sale promoting-purpose closure comprising:

a closure shell having a visable indicia on the inner bottom surface thereof; and a gasket peelably bonded to said inner bottom surface of said closure shell, said gasket having a center panel with a tear strip portion defined therein by a breakable line, whereby said tear strip portion may be separated from said inner bottom surface along said breakable line and be used to completely peel off the entire gasket.

2. The closure of claim 1 wherein the tear strip portion has a knob formed at its end.

3. The closure of claim 1 wherein the closure shell is a crown closure shell.

* * * * *